US008939353B1

(12) United States Patent
Blocker

(10) Patent No.: US 8,939,353 B1
(45) Date of Patent: Jan. 27, 2015

(54) PERSONALIZED MAILBOX FLAG SYSTEM

(71) Applicant: Sanford A. Blocker, Irmo, SC (US)

(72) Inventor: Sanford A. Blocker, Irmo, SC (US)

( * ) Notice: Subject to any disclaimer, the term of this patent is extended or adjusted under 35 U.S.C. 154(b) by 0 days.

(21) Appl. No.: 13/955,609

(22) Filed: Jul. 31, 2013

(51) Int. Cl.
*A47G 29/14* (2006.01)
*A47G 29/122* (2006.01)

(52) U.S. Cl.
CPC ..... *A47G 29/122* (2013.01)
USPC ..... 232/34; 232/38; 40/606.06

(58) Field of Classification Search
CPC ..... A47G 29/1209; A47G 29/122; A47G 2029/122
USPC ..... 232/17, 34, 38; 40/606.06
See application file for complete search history.

(56) References Cited

U.S. PATENT DOCUMENTS

| | | | | | |
|---|---|---|---|---|---|
| 4,813,595 | A * | 3/1989 | Johns et al. | ..... | 232/17 |
| 4,991,769 | A * | 2/1991 | Todd | ..... | 232/17 |
| 5,000,379 | A * | 3/1991 | LaRue | ..... | 232/17 |
| 5,035,356 | A * | 7/1991 | Granger | ..... | 232/17 |
| 5,106,016 | A * | 4/1992 | Beckmann | ..... | 232/17 |
| 5,207,378 | A * | 5/1993 | Detchon | ..... | 232/38 |
| D350,007 | S | 8/1994 | Ferguson | | |
| 5,435,483 | A * | 7/1995 | Cox | ..... | 232/38 |
| 5,445,317 | A | 8/1995 | Sokolowski | | |
| D365,910 | S | 1/1996 | King | | |
| 5,715,995 | A * | 2/1998 | Huskey | ..... | 232/34 |
| D475,172 | S | 5/2003 | Jones | | |
| D479,031 | S | 8/2003 | Hostetler | | |
| 6,726,089 | B1 * | 4/2004 | Jones | ..... | 232/38 |
| 6,772,938 | B2 * | 8/2004 | Martin et al. | ..... | 232/38 |
| 7,028,883 | B1 * | 4/2006 | Choi | ..... | 232/35 |
| 7,587,846 | B2 * | 9/2009 | Khan | ..... | 40/606.06 |
| D620,225 | S | 7/2010 | Dinh | | |
| 2002/0092901 | A1 * | 7/2002 | Paschal | ..... | 232/38 |

* cited by examiner

*Primary Examiner* — William Miller

(57) ABSTRACT

A personalized mailbox flag system for displaying a sports team logo or other design such as a seasonal symbol or religious symbol. A mailbox sleeve is mounted over an existing mailbox. A decorative component is disposed on the mailbox sleeve. A decorative component is also disposed on the flag, which can pivot about the mailbox sleeve. Disposed on the free end of the flag is a décor mount, which displays a decorative component. The décor mount can pivot so as to orient the decorative component such that onlookers can read it.

1 Claim, 5 Drawing Sheets

(END VIEW)

(BOTTOM VIEW)

PERSONALIZED MAILBOX FLAG SYSTEM

BACKGROUND OF THE INVENTION

Mailboxes are typically equipped with a traditional flag. The present invention features a personalized mailbox flag system for displaying a sports team logo (e.g., college sports, high school sports, professional sports) or other design. The present invention is not limited to sports team logos and may feature any other appropriate design such as a religious symbol, a seasonal symbol or holiday symbol or other design (e.g., hunter's symbol, race day design, etc). The system of the present invention allows an individual to show team spirit.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a personalized mailbox flag system (100) for displaying personal décor on a mailbox. In some embodiments, the system (100) comprises (a) a rigid mailbox sleeve (110) for placing over an existing mailbox (101), the mailbox sleeve (110) has a first end (111) and a second end (112) opposite the first end (111), a first side (113), a second side (114), and a top edge (115), the mailbox sleeve (110) is curved having a U-shaped cross section when viewed from the first end (111), wherein a first decorative component (130) is disposed on one or both of the first side (113) and the second side (114) of the mailbox sleeve (110); (b) a flag (210) having a pivot end (211), a free end (212), and an outer surface (213), the pivot end (211) is pivotally attached to either the first side (113) or the second side (114) of the mailbox sleeve (110) via a first pivot peg (240), the flag (210) can pivot about the first pivot peg (240) between at least a first position wherein the free end (212) of the flag (210) extends above the top edge (115) of the sleeve (110) and a second position wherein the free end (212) of the flag (210) does not extend above the top edge (115) of the sleeve (110), a second decorative component (230) is disposed on the outer surface (213) of the flag (210); and (c) a décor mount (310) pivotally attached to the free end (212) of the flag (210) via a second pivot peg (340), a third decorative component (330) is disposed on an outer surface of the décor mount (310), the décor mount (310) can pivot about the pivot peg (340) in at least a first direction and a second direction so as to orient the third decorative component (330) as desired.

In some embodiments, the system (100) further comprises a rigid first flange (116*a*) disposed at a bottom edge (117) of the first side (113) of the mailbox sleeve (110) and a rigid second flange (116*b*) disposed at a bottom edge (117) of the second side (114) of the mailbox sleeve (110), the flanges (116) extend inwardly toward each other, the flanges (116) together function to help secure the mailbox sleeve (110) on the existing mailbox (101). In some embodiments, the system (100) further comprises an address area (132) disposed on the first side (113) of the sleeve (110), the second side (114) of the sleeve (110), or both the first side (113) and second side (114) of the sleeve (110).

In some embodiments, the first decorative component (130) comprises a team logo, a team mascot, a phrase, a word, a picture, a religious symbol, a seasonal symbol, a holiday symbol, or a combination thereof. In some embodiments, the second decorative component (230) comprises a team logo, a team mascot, a phrase, a word, a picture, a religious symbol, a seasonal symbol, a holiday symbol, or a combination thereof. In some embodiments, the third decorative component (330) comprises a team logo, a team mascot, a phrase, a word, a picture, a religious symbol, a seasonal symbol, a holiday symbol, or a combination thereof.

In some embodiments, the flag (210) is removable. In some embodiments, the décor mount (310) is removable.

In some embodiments, the free end (212) of the flag (210) comprises at least a first side (212*a*), a second side (212*b*), and a third side (212*c*). In some embodiments, the décor mount (310) comprises at least a first side (312*a*), a second side (312*b*), and a third side (312*c*). In some embodiments, the sides (312*a*, 312*b*, 312*c*) of the décor mount (310) align with the sides (212*a*, 212*b*, 212*c*) of the free end (212) of the flag (310).

DESCRIPTION OF PREFERRED EMBODIMENTS

Figure 1:
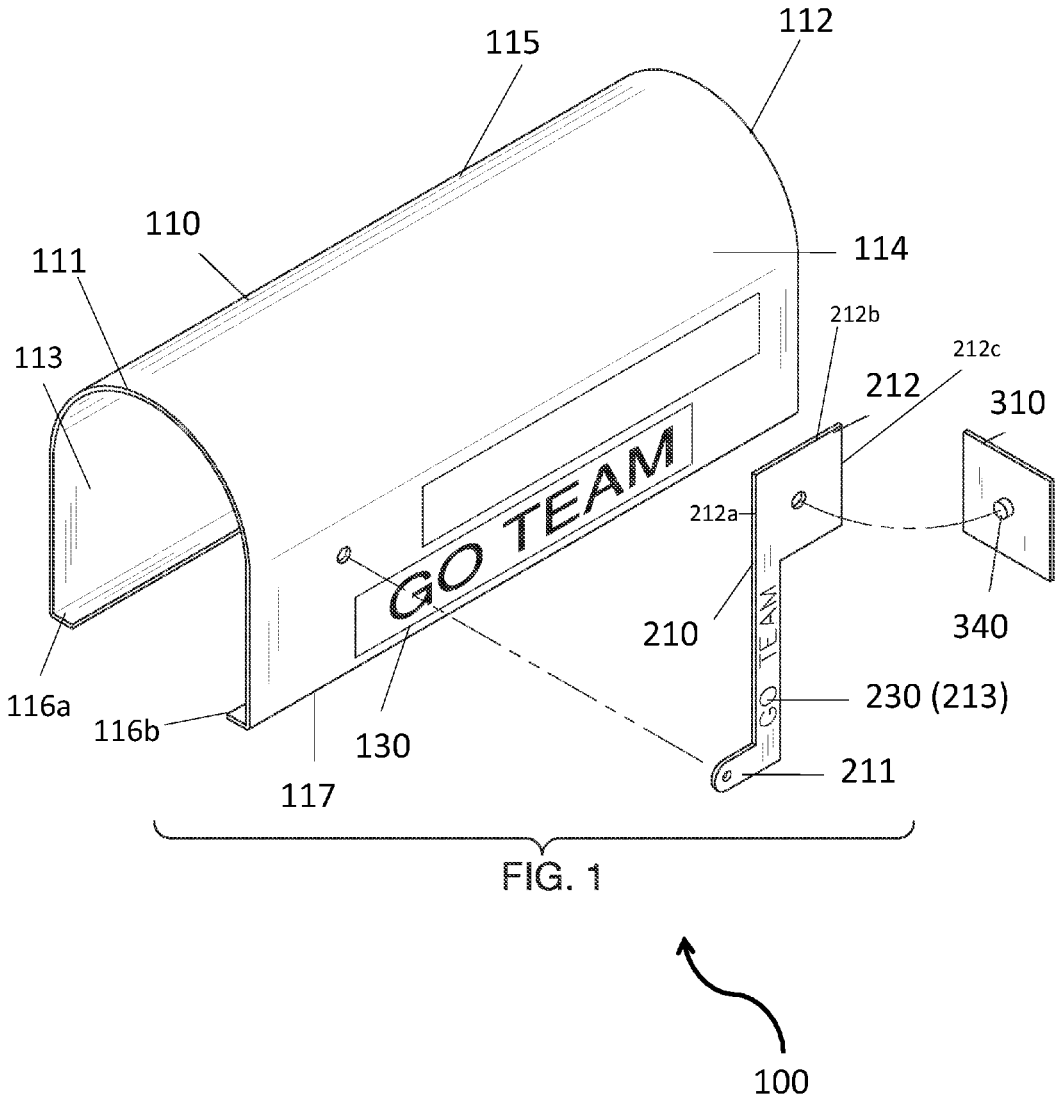
FIG. 1 shows a perspective view of the system of the present invention.

Following is a list of elements corresponding to a pa element referred to herein:

100 mailbox flag system
101 existing mailbox
110 sleeve
111 first end of sleeve
112 second end of sleeve
113 first side of sleeve
114 second side of sleeve
115 top edge of sleeve
116*a* first flange
116*b* second flange
117 bottom edge of sides
130 first decorative component
132 address area
210 flag
211 pivot end of flag
212 free end of flag
212*a* first side of free end of flag
212*b* second side of free end of flag
212*c* third side of free end of flag
213 outer surface of flag
230 second decorative component
240 first pivot peg
310 décor mount
312*a* first side of décor mount
312*b* second side of décor mount
312*c* third side of décor mount
330 third decorative component
340 second pivot peg Referring now to FIG. 1-5, the present invention features a personalized mailbox flag system (100) for displaying a sports team logo or other design. The system (100) of the present invention is not limited to sports team logos and may feature any other appropriate design such as a religious symbol, a seasonal symbol or holiday symbol or other design.

The system (100) comprises a mailbox sleeve (110) for placing over an existing mailbox (101). The mailbox sleeve (110) is curved (e.g., having a U shaped cross section when viewed from the end). The mailbox sleeve (110) has a first end (111) (e.g., a "front end"), a second end (112) (e.g., a "back end"), a first side (113), a second side (114) opposite the first side (113), and a top edge (115). In some embodiments, a first flange (116*a*) is disposed at the bottom edge (117) of the first side (113). In some embodiments, a second flange (116*b*) is disposed at the bottom edge (117) of the second side (114). The flanges (116) may extend inwardly toward each other (see FIG. 1). The flanges (116) may function to help secure the sleeve (110) on the existing mailbox (101).

In some embodiments, a first decorative component (130) is disposed on the first side (113) and/or the second side (114) of the sleeve (110). The decorative component (130) may comprise a team logo, a picture, or any other design or word/phrase. For example, as shown in FIG. 1, the first decorative component (130) may comprise the phrase "GO TEAM" or the like. The decorative component (130) is not limited to "GO TEAM" and may comprise any other appropriate phrase. In some embodiments, more than one decorative component (130) is disposed on the first side (113) and/or the second side (114) of the sleeve (110). In some embodiments, an address area (132) is disposed on the first side (113) and/or the second side (114) of the sleeve (110).

The system (100) further comprises a flag (210). The flag (210) has a pivot end (211), a free end (212), and an outer surface (213). The pivot end (211) is pivotally attached to the second side (114) (or first side (113)) of the sleeve (110), e.g., via a pivot component (e.g., first pivot peg (240)). In some embodiments, the flag (210) is attached to the sleeve (110) near the first end (111) as shown in FIG. 1. In some embodiments, the flag (210) is L-shaped. In some embodiments, the flag (210) is shaped as shown in FIG. 1. The flag (210) is not limited to the aforementioned shapes.

Figure 2:
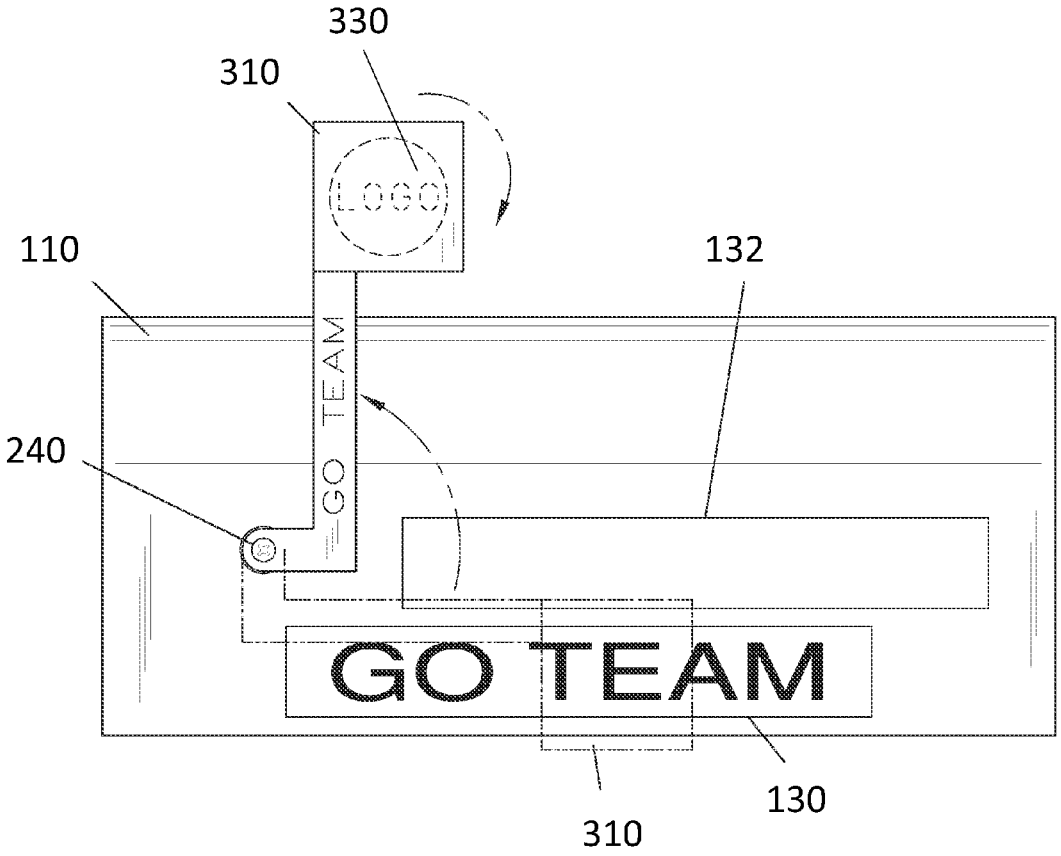
FIG. 2 shows a side view of the system of the present invention.
Figure 3:
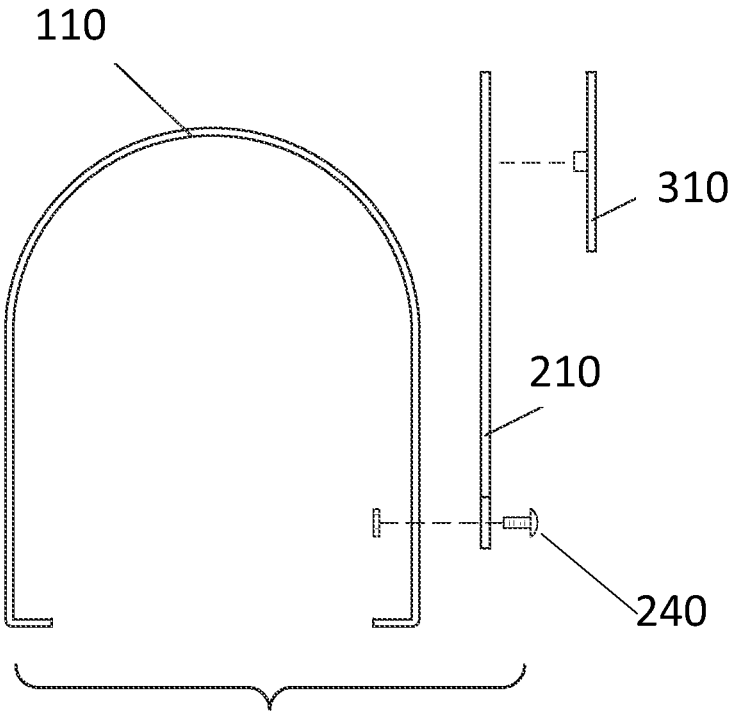
FIG. 3 shows an end view of the system of the present invention.
Figure 4:
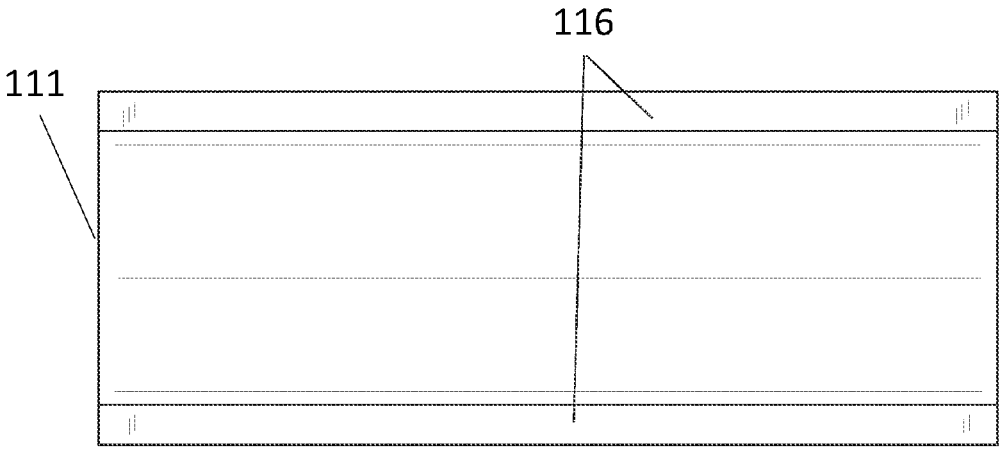
FIG. 4 shows a bottom view of the system of the present invention.

The flag (210) is adapted to pivot about the pivot component (e.g., first pivot peg (240)) between at least a first position (e.g., an up position) wherein the free end (212) of the flag (210) extends above the top edge (115) of the sleeve (110) and a second position (e.g., down position) wherein the free end (212) of the flag (210) does not extend above the top edge (115) of the sleeve (110). Typically, the up position is used to designate that the mailbox contains mail to be collected by a postal worker. FIG. 2 shows the first position and second position of the flag (210).

In some embodiments, a second decorative component (230) is disposed on the outer surface (213) of the flag (210). The decorative component (230) may comprise a team logo, a picture, or any other design or word/phrase. For example, as shown in FIG. 1, the decorative component (230) may comprise the phrase "GO TEAM" or the like. The decorative component (230) is not limited to "GO TEAM" and may comprise any other appropriate phrase. In some embodiments, more than one decorative component (230) is disposed on the outer surface (213) of the flag (210).

In some embodiments, the flag (210) is removable. For example, the flag (210) can be removed from the sleeve (110) and replaced with an alternate flag.

The system (100) further comprises a décor mount (310) pivotally attached to the free end (212) of the flag (210). In some embodiments, the décor mount (310) is pivotally attached to the flag (210) via a pivot peg (340) as shown in FIG. 1. The décor mount (310) has a third decorative component (330) disposed on its outer surface. The decorative component (330) may comprise a team logo, a picture, or any other design or word/phrase. In some embodiments, more than one decorative component (330) is disposed on the outer surface of the décor mount (310).

The décor mount (310) can pivot about the pivot peg (340) in a first direction and a second direction (e.g., clockwise, counterclockwise). The pivoting allows the decorative component (330) to be oriented properly so that onlookers can read the decorative component (330).

In some embodiments, the décor mount (310) is removable. For example, the décor mount (310) can be removed from the flag (210) and replaced with an alternate décor mount.

Figure 5:
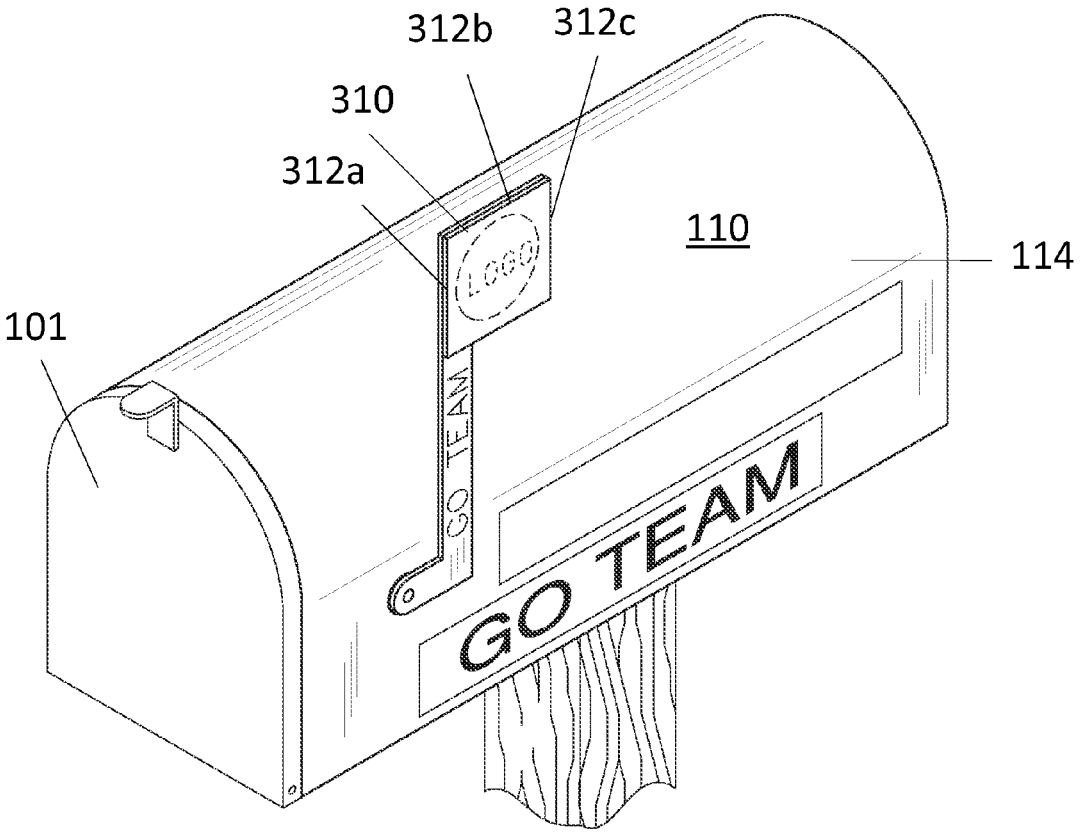
FIG. 5 shows an in-use view of the system of the present invention.

In some embodiments, the décor mount (310) has one side (e.g., is generally circular). In some embodiments, the décor mount (310) comprises three sides. In some embodiments, the décor mount (310) comprises at least three sides. For example, in some embodiments, the décor mount (310) comprises at least a first side (312*a*), a second side (312*b*), and a third side (312*c*). In some embodiments, the free end (212) of the flag (210) comprises three sides. In some embodiments, the free end (212) of the flag (210) comprises at least three sides. For example, in some embodiments, the free end (212) of the flag (210) comprises at least a first side (212*a*), a second side (212*b*), and a third side (212*c*). In some embodiments, the three sides (312*a*, 312*b*, 312*c*) of the décor mount (310) align with the three sides (212*a*, 212*b*, 212*c*) of the free end (212) of the flag (310) (e.g., as shown in FIG. 5). In some embodiments, the three sides (312*a*, 312*b*, 312*c*) of the décor mount (310) do not align with the three sides (212*a*, 212*b*, 212*c*) of the free end (212) of the flag (310).

The system (100) of the present invention may be constructed in a variety of sizes. For example, in some embodiments, the flag (210) is between about 2 to 5 inches in length as measured from the pivot end (211) to the free end (212). In some embodiments, the flag (210) is between about 4 to 6 inches in length as measured from the pivot end (211) to the free end (212). In some embodiments, the flag (210) is between about 4 to 7 inches in length as measured from the pivot end (211) to the free end (212). In some embodiments, the flag (210) is greater than 7 inches in length.

As used herein, the term "about" refers to plus or minus 10% of the referenced number. For example, an embodiment wherein the flag (210) is about 6 inches in length includes a flag (210) that is between 5.4 and 6.6 inches in length.

The disclosures of the following U.S. Patents are incorporated in their entirety by reference herein: U.S. Pat. No. 5,445,317; U.S. Design Pat. No. 350,007; U.S. Design Pat. No. 365,910; U.S. Design Pat. No. 475,172; U.S. Design Pat. No. 479,031; U.S. Design Pat. No. 620,225.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A personalized mailbox flag system (100) for displaying personal décor on a mailbox, said system (100) consisting of:

(a) a mailbox sleeve (110) for placing over an existing mailbox (101), the mailbox sleeve (110) has a first end (111) and a second end (112) opposite the first end (111), a first side (113), a second side (114), and a top edge (115), the mailbox sleeve (110) is curved consisting of a U-shaped cross section when viewed from the first end (111), wherein a first decorative component (130) is disposed on one or both of the first side (113) and the second side (114) of the mailbox sleeve (110);

(b) a flag (210) consisting of a pivot end (211), a free end (212), and an outer surface (213), the pivot end (211) is pivotally attached to either the first side (113) or the second side (114) of the mailbox sleeve (110) via a first pivot peg (240), the flag (210) pivots about the first pivot peg (240) between at least a first position wherein the free end (212) of the flag (210) extends above the top edge (115) of the sleeve (110) and a second position wherein the free end (212) of the flag (210) does not extend above the top edge (115) of the sleeve (110), a second decorative component (230) is disposed on the outer surface (213) of the flag (210); and (c) a décor mount (310) pivotally attached to the free end (212) of the flag (210) via a second pivot peg (340), a third decorative component (330) is disposed on an outer surface of the décor mount (310), the décor mount (310) pivots about the pivot peg (340) in at least a first direction and a second direction so as to orient the third decorative component (330) as desired.

* * * * *